US005888143A

United States Patent [19]

McKinney

[11] Patent Number: 5,888,143

[45] Date of Patent: Mar. 30, 1999

[54] BOWLING ESTABLISHMENT VERTICALLY STABILIZED MASKING APPARATUS

[75] Inventor: Charles R. McKinney, Whitehall, Mich.

[73] Assignee: Brunswick Bowling & Billiards Corporation, Muskegon, Mich.

[21] Appl. No.: 102,687

[22] Filed: Jun. 23, 1998

[51] Int. Cl.[6] ..... A63D 5/04

[52] U.S. Cl. ..... 473/54; 473/115

[58] Field of Search ..... 473/54, 64, 73, 473/115

[56] References Cited

U.S. PATENT DOCUMENTS

| | | | |
|---|---|---|---|
| 3,037,301 | 6/1962 | Siepel | 35/63 |
| 3,144,229 | 8/1964 | Wolters | 248/31 |
| 3,269,035 | 8/1966 | Bong | 35/63 |
| 3,394,497 | 7/1968 | Case | 49/140 |
| 4,339,129 | 7/1982 | Gautraud | 273/54 |
| 5,087,041 | 2/1992 | Gagnon | 273/54 |
| 5,356,346 | 10/1994 | Katje et al. | 473/54 |

*Primary Examiner*—William M. Pierce

*Attorney, Agent, or Firm*—Price, Heneveld, Cooper, DeWitt & Litton

[57] ABSTRACT

A bowling lane masking unit having an elevatable panel with first and second pulley wheels at the lower corners, a pair of stabilizing cables each anchored on both ends, passing around the pulley wheels and across the panel to retain the panel vertically aligned when shifted up and down, and a shiftable latch retaining the panel in elevated position.

19 Claims, 5 Drawing Sheets

BOWLING ESTABLISHMENT VERTICALLY STABILIZED MASKING APPARATUS

BACKGROUND OF THE INVENTION

This invention relates to bowling lane masking units, and particularly to a stabilized masking unit vertical lift.

A bowling facility masking unit is a graphic panel mounted directly in front of all pinsetter mechanisms in a bowling center. It provides an aesthetically pleasing structure blocking the bowler's view of the pinsetter operation mechanism above the pins. A variety of scenes/graphics are available as standard products. Custom graphic development is also offered to customers with special graphic requests. In addition to providing the masking function, a double upper and lower set of masking units can be employed, with the lower panel also serving as a mounting location and visual contrast for the light assembly that displays pins remaining after the first and second bowled ball. A representative masking unit is disclosed in U.S. Pat. No. 4,339,129. Bowling center masking installations usually consist of both upper and lower masking panels. However, in some installations only the lower panel is employed and the upper panel is omitted.

During normal bowling sessions, the upper and lower masking unit panels usually remain in place and provide the masking function described above. However, during periods between bowling sessions, the lanes may be cleaned and oiled. In addition, during bowling sessions, minor repairs or adjustments to the pinsetter may be required. Each of these conditions requires that the lower panel, with optional ball light assemblies, be quickly and easily moved by a single individual to provide ready access. However, the moved lower panel cannot physically block any bowling lane or visually interfere with bowling in adjacent lanes. Thus, the preferred temporary storage position of the lower panel is upward, preferably directly behind the upper panel. A required operating feature is that the lower panel can be easily lifted by a single individual from anywhere along the length of the masking unit, i.e., the extreme left, center, or righthand edge, without binding of the panel. The lower panel must be automatically captured and physically held in place by components of the supportive frame until cleaning or repair is completed.

The functions defined above are currently accomplished with garage door type torsion spring technology. A stiff torsion spring is mounted symmetrically around a horizontally oriented, solid, cylindrical, cross lane, steel bar with sprockets assembled to each end of the bar. The sprockets drive vertically oriented roller link chains located on each end of the masking unit frame. These chains are joined with additional vertical frame members that support the graphic panels. This mechanical system is designed and assembled such that the weight of the graphic panel and its considerable supportive structure can be raised at any point across its width without excessive binding of the assembly. The amount of lifting assistance provided by the torsion spring is determined by the stored energy of the spring, and can be adjusted by changing the number of turns or the "pre load" of the spring. It is a well-known fact that the adjustment of the spring can be difficult if attempted by an untrained and/or inexperienced person. Moreover, the mechanical implementation of the methodology described above requires very substantial mechanical structure to support the numerous mechanical components. The end result is a complex, heavy, and relatively costly assembly to produce, package, install and maintain.

SUMMARY OF THE INVENTION

The present invention employs the concept of cables and pulleys so assembled with the masking unit that the vertical masking panel with its supportive structure is readily lifted using a simplified assembly and held square throughout its vertical travel regardless of the point of lifting across the unit.

The advantages of bowling center masking units disclosed herein include inherent simplicity and lack of a requirement for a complex and heavy supportive frame for the graphic panel. The ratio of frame and lifting mechanism weight to graphic panel weight can be greatly reduced. Thus, it is possible for a single individual to easily vertically lift the lower panel from the extreme left, center, or righthand edge, and do so without binding of the panel and without the need of spring assistance. However, if optional lift assistance is desired, one or two lighter, more easily adjusted and cost-effective enclosed spring powered cable reels can be provided.

These and other advantages are achieved by a crossover cable connection between upper and lower cable attachments to parallel spaced upright supports, interengaged with first and second pulleys on the masking unit.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
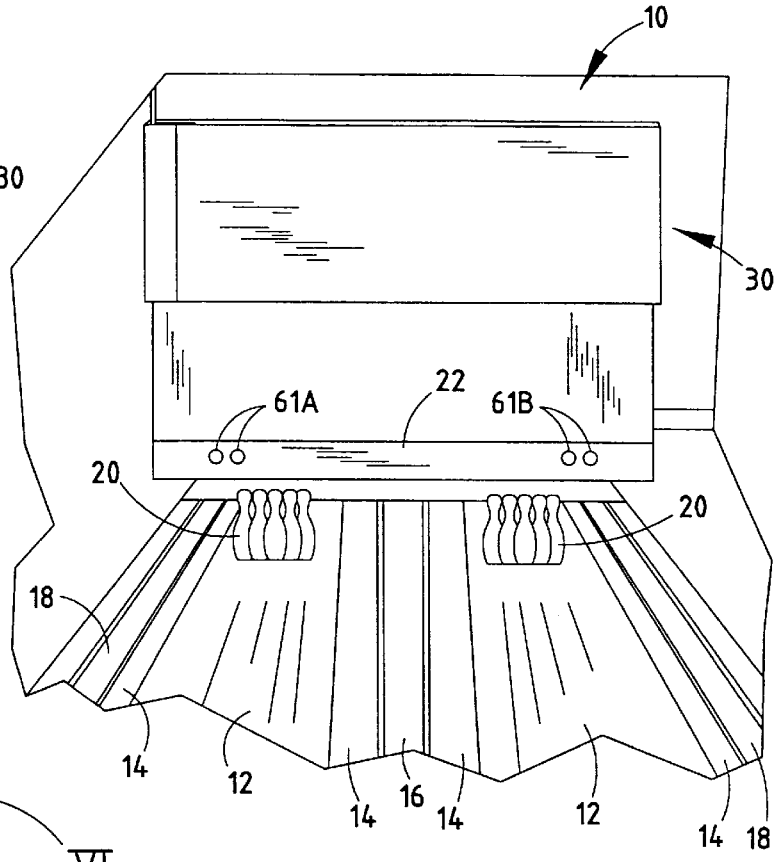
FIG. 1 is a partial perspective view of two adjacent lanes of a bowling establishment, showing a masking unit assembly extending across both lanes.

Referring now to the drawings, the assembly 10 depicted in FIG. 1 sets forth the far end portion of two bowling lanes including the pin decks of two adjacent representative bowling lanes 12, each lane having a pair of gutters 14 astraddle the lane in conventional fashion, and lane dividers 18. Accommodating these two lanes is a typical ball return (not shown) having a ball return cover 16 thereover. Shown diagrammatically on the pin deck end of lanes 12 are groups of respective ten pins 20 arranged in the typical triangular configuration. The two individual pin deck areas of the two lanes are separated by a conventional vertical separator or kick back panel 22.

the masking unit assembly 30 is illustrated covering the pin setters of two lanes, and in its preferred form including an upper stationary masking panel 32 and lower shiftable masking panel 42. Upper panel 32 is mounted on vertically spaced standoff brackets 36, in turn mounted to stationary, laterally spaced, vertical support members 44A and 44B mounted to floor supports at the base brackets 38 thereof and optionally also at the upper ends thereof.

Figure 3:
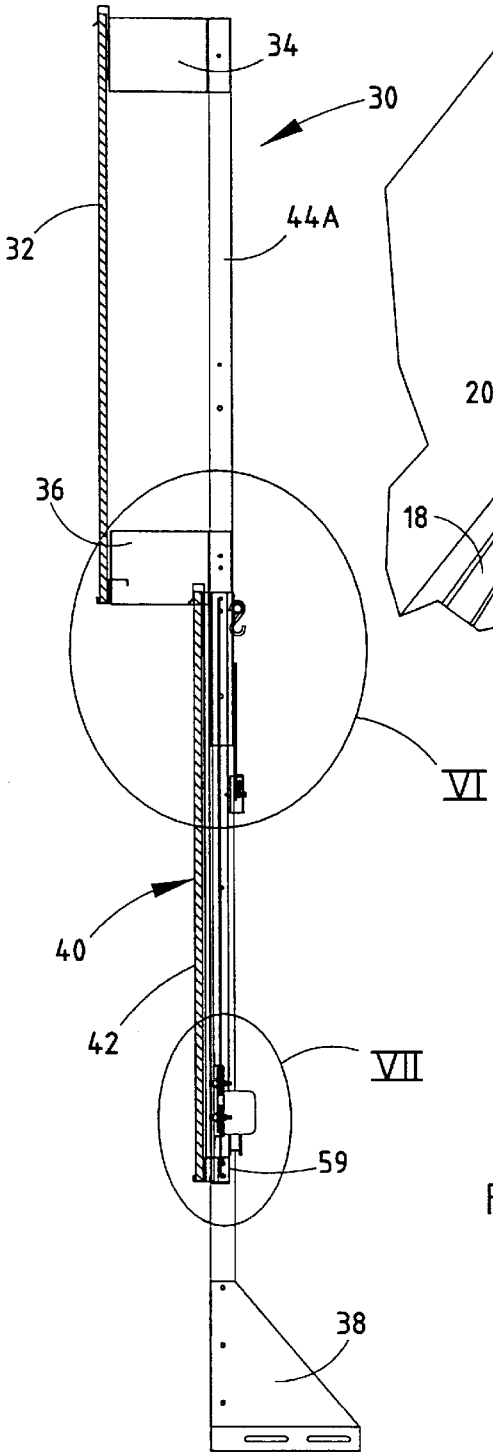
FIG. 3 is a side elevational view of the masking unit.
Figure 2:
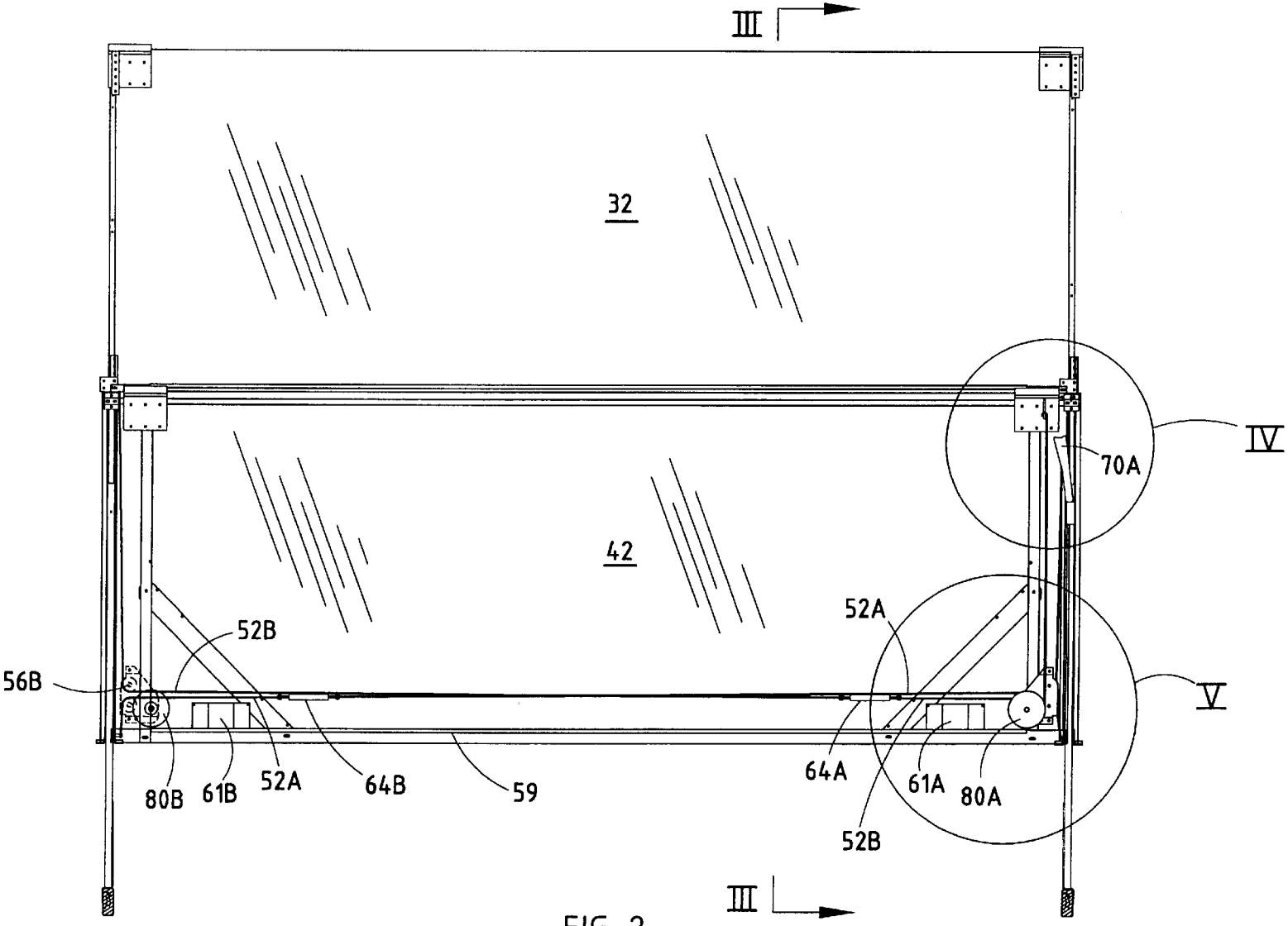
FIG. 2 is a rear elevational view of the masking unit.
Figure 4:
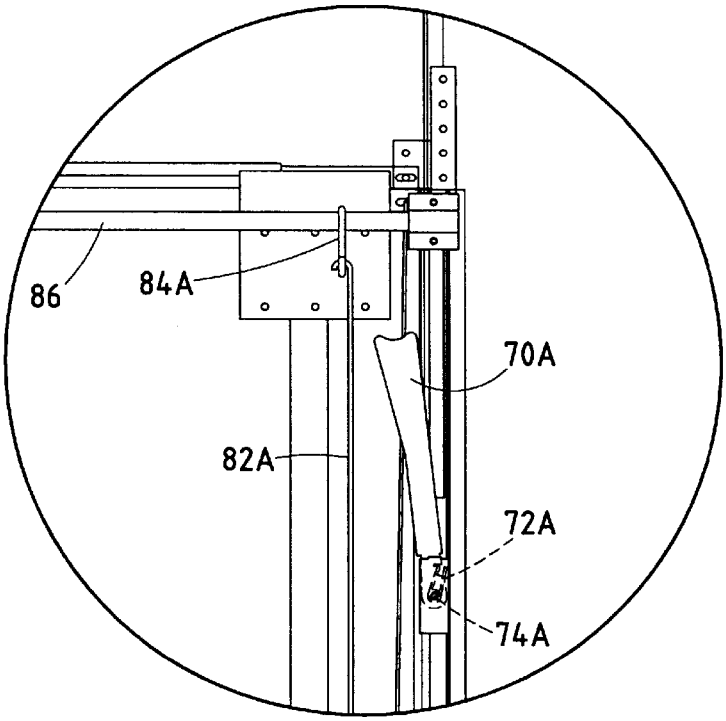
FIG. 4 is a somewhat enlarged elevational view of the sectional portion designated IV in FIG. 2.
Figure 5:
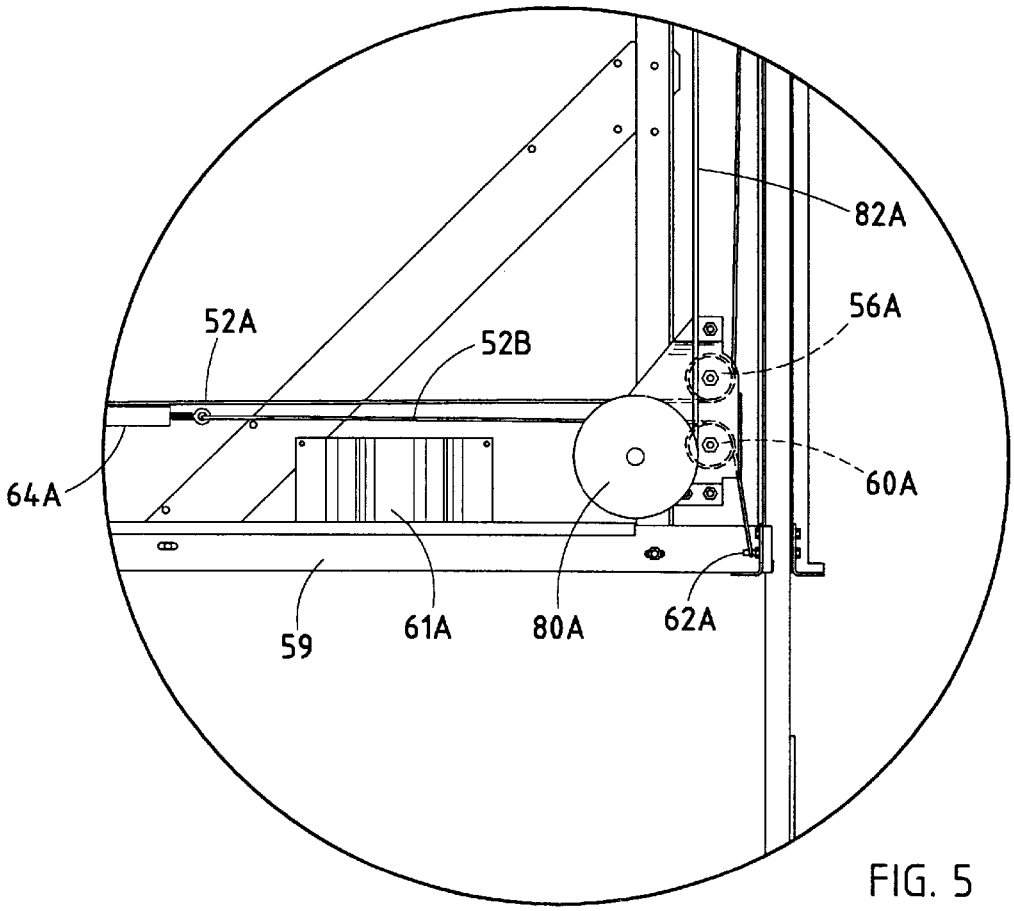
FIG. 5 is a somewhat enlarged view of the sectional portion designated V in FIG. 2.

Below upper masking unit 32, preferably so as to slightly overlap the upper graphics panel 32, is a lower graphics panel subassembly 40. This subassembly comprises a lower graphics panel 42 which is slightly behind upper panel 32 and is vertically movable between a lower position depicted in FIGS. 2, 3 and 8A, and an elevated position depicted in FIG. 8B. In the lowered position, panel 42 is in front of the pinsetters (not shown). In the elevated position, lower graphics panel 42 is substantially behind upper graphics panel 32 and above the pinsetters. These panels 32 and 42 can have a variety of selected display graphics thereon, e.g., name of the equipment, name of the bowling establishment, scenic graphics, club trademarks, simple colors, or any other chosen display. Hence, the panels are depicted with diagonal shading lines representing any such graphics. During elevation and lowering of the lower graphics panel, it is vertically stabilized to prevent it from tilting in one direction or another, even if lifted from a position other than its center, thereby enabling it to be elevated by a person lifting anywhere along the length of the panel, i.e., at either end as well as in the center.

The stabilizing subassembly includes first and second cables 52A and 52B preferably of woven synthetic material or wire. Cable 52A has its upper end anchored at fixed cable anchor 54A (FIG. 8A) in the area where upper and lower graphics panels 32 and 42 overlap. Anchor 54A is preferably on support 44A. The cable extends down on the one side of the lower graphics panel and around a pulley wheel 56A mounted on bracket 58A. Cable 52A then extends across the length of the bottom portion of graphics panel 42, around pulley wheel 60B at the opposite side and the bottom of graphics panel 42, and down to fixed cable anchor 62B attached to the bottom part of vertical support 44B. Tension adjustors 64A and 64B such as a turnbuckle are provided in cable 52A and cable 52B. Cable 52B is anchored at its upper end to anchor 54B at support 44B. The cable extends downwardly adjacent the other side of the lower graphics panel and around pulley wheel 56B on bracket 58B, and then across the bottom of the lower graphics panel 42, around the lower pulley wheel 60A mounted on bracket 58A, and then to fixed anchor 62A preferably attached to the bottom part of vertical support 44A. Cable 52B includes a tension adjustor 64A between its ends. Brackets 58A and 58B may be attached to a cross base member 59 at the bottom of panel 42.

This pair of cables connected in this fashion causes raising and lowering of lower display panel 42 to be stabilized, maintaining its exact upright condition rather than tilting one way or another, even if lifted at one end rather than in the middle. The pulley wheels 56A and 56B, and 60A and 60B, are guided on the cables 52A and 52B in stabilized manner. Also optionally mounted on cross member 59 are conventional light subassemblies 61A and 61B (FIG. 2) to show the first and second ball to be rolled, or the upright pin status, or possibly for other purposes.

Figure 8B:
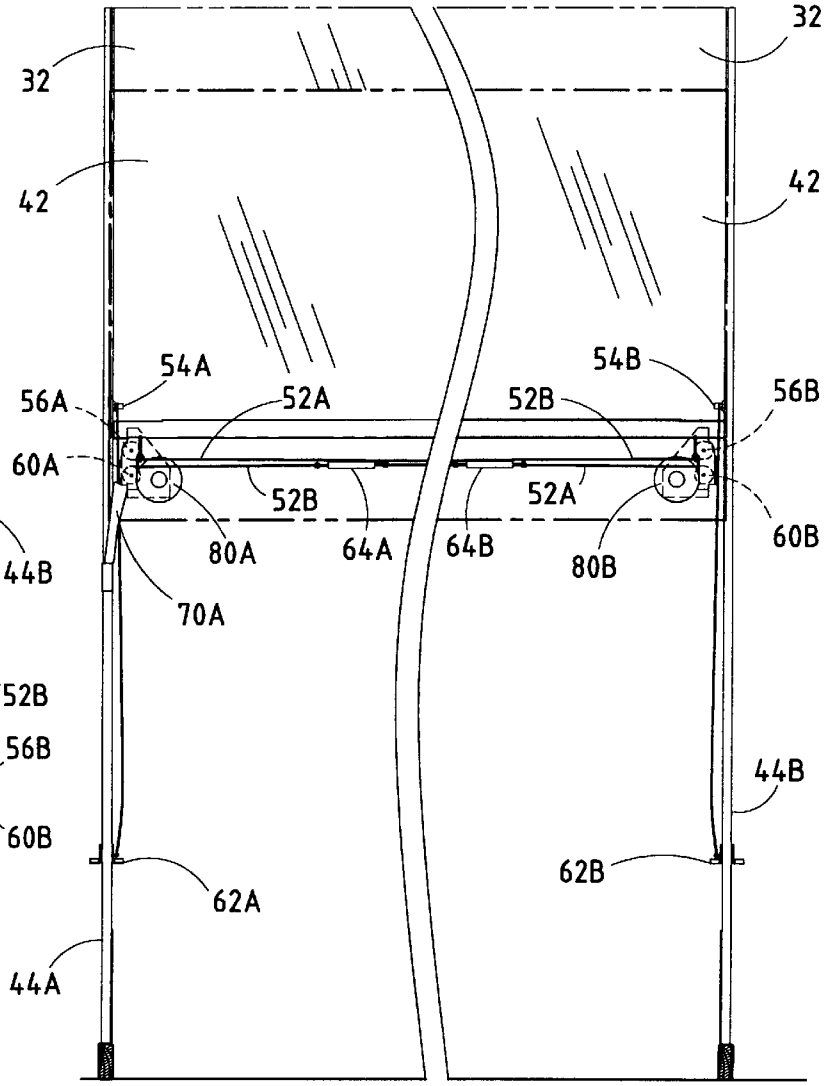
FIG. 8B is a front elevational view of the masking unit assembly shown with the lower masking panel elevated, latched in elevated position, and depicted in phantom lines.
Figure 8A:
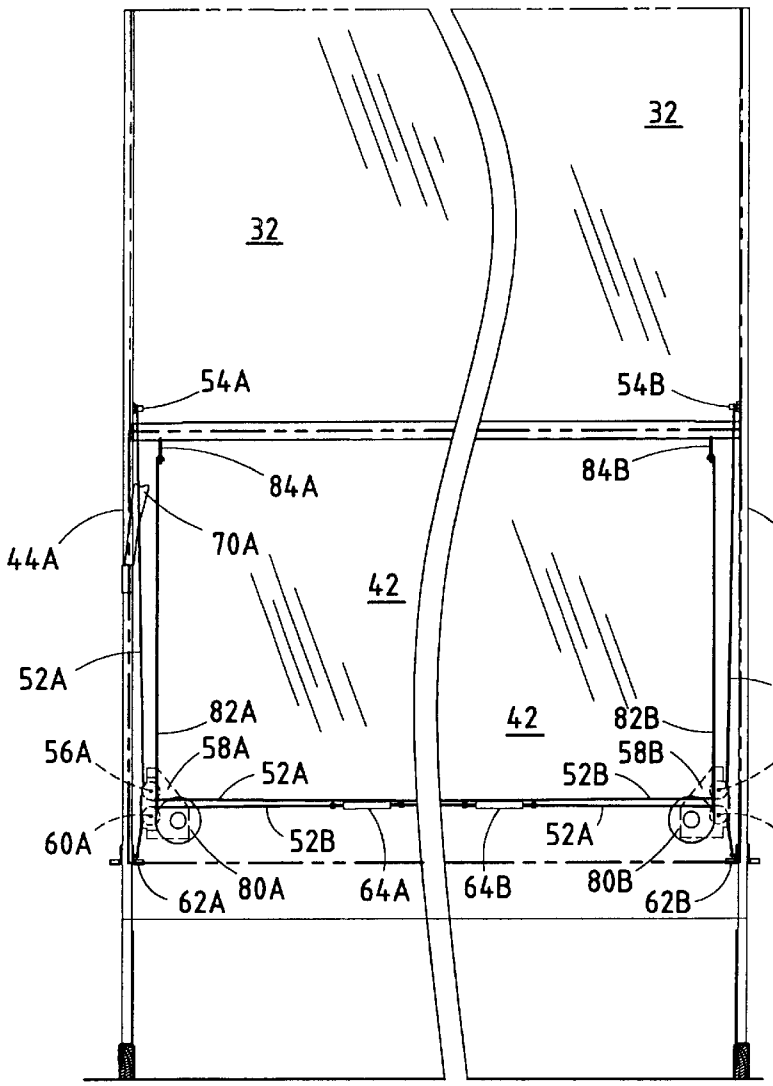
FIG. 8A is a front elevational view of the masking unit assembly with the lower masking panel in the lowered position and depicted in phantom lines.

Graphics panel 42 can be retained in elevated position to allow workmen to have unhindered access to the pinsetting machines. It is retained in this elevated position by a latch 70A on one side. The latch constitutes an elongated element pivotally mounted at its lower end to support 44A so as to be pivotally positionable at its upper end beneath the lower edge portion of panel 42 in the panel elevated position as depicted in FIG. 8B. A torsion spring 72A mounted on pivot pin 74A (FIG. 6) of latch 70A biases the latch toward its position beneath the bottom edge of panel 42 such that when panel 42 is elevated, the latch springs into position to retain the panel in elevated condition. The one latch will accommodate the unit even though on one side, because the panel is stabilized over its length when raised.

Figure 6:
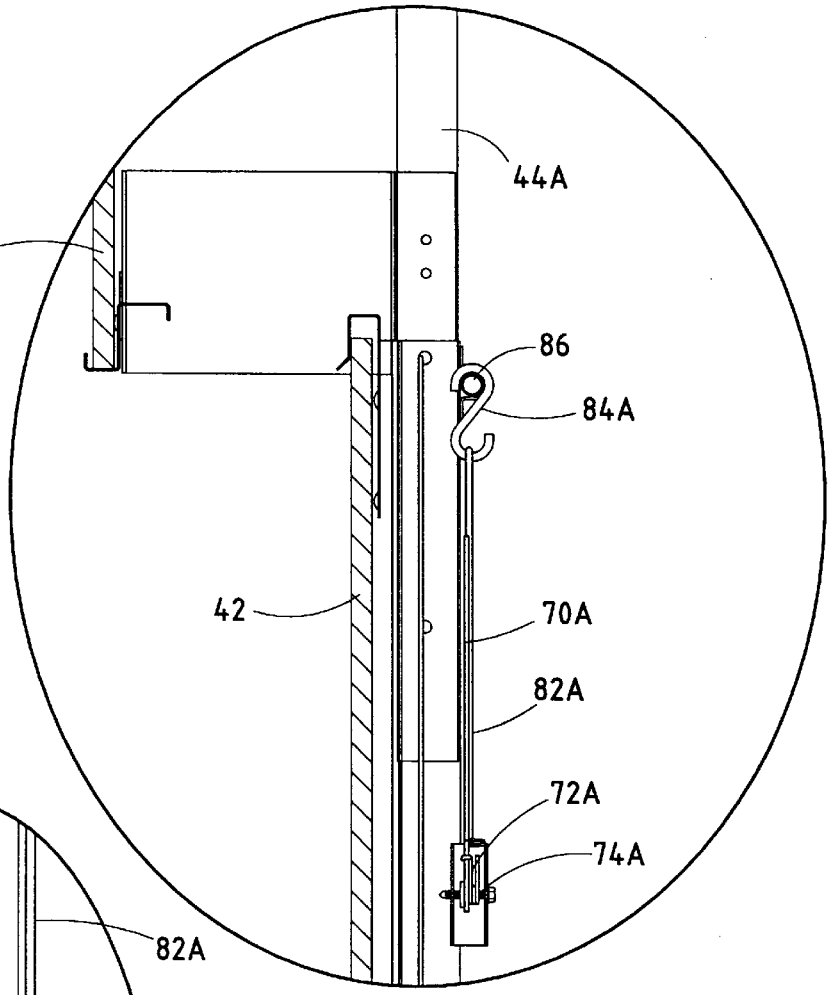
FIG. 6 is a somewhat enlarged view of the sectional portion designated VI in FIG. 3.
Figure 7:
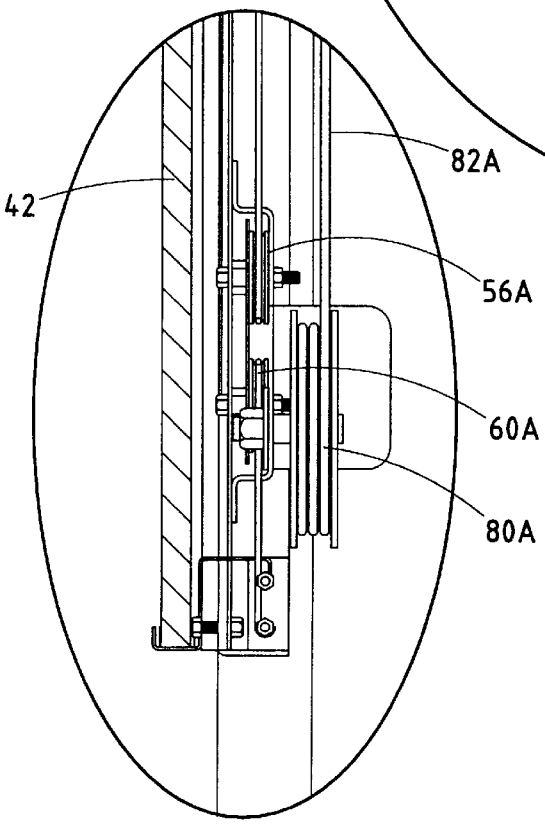
FIG. 7 is a somewhat enlarged elevational view of the sectional portion designated VII in FIG. 3.

In the apparatus depicted, there are also shown a pair of optional windup reels 80A and 80B on opposite ends of the structure, each having a windup tension rope, e.g., a synthetic woven rope or a wire rope. Ropes 82A and 82B, have their upper ends fixedly attached by S hooks 84A and 84B attached to a fixed cross bar 86 (FIG. 6). Wind up torsion on reels 80A and 80B can be adjusted to create the desired lifting force on lower graphics panel 42 such that a desired manual lifting force required of the human operator can be achieved.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A bowling lane masking unit comprising:

a pair of upright, parallel, vertically oriented supports spanning a space therebetween for receiving a masking unit, each support having an upper end portion and a lower end portion;

a rectangular masking unit between said supports comprising a masking panel for a graphic display, at least a pair of lower corners opposite each other, and a pair of first and second pulley wheels at each said corner;

a pair of lower and upper stabilizing cable anchors, said lower stabilizing cable anchors being at said lower end portions and said upper stabilizing cable anchors being at said upper end portions;

a pair of stabilizing cables extending between said supports, each of said stabilizing cables having one end attached to one of said lower cable anchors, extending over said first pulley wheel on the adjacent masking unit lower corner and under said second pulley wheel on the opposite masking unit lower corner, and having a second end attached to one of said upper cable anchors at the opposite support;

whereby said masking unit can be elevated in a stabilized manner by lifting at any portion of said masking unit.

2. The bowling lane masking unit in claim 1 including a latch adjacent at least one of said upper end portions of said supports shiftable to a position to retain said masking unit in an elevated position.

3. The bowling lane masking unit in claim 1 including a pair of suspension rope reels adjacent said lower corners, and having suspension ropes, said suspension ropes extending from said reels and having an upper end anchored adjacent said upper end portions of said supports for assisting elevation of said masking unit.

4. The bowling lane masking unit in claim 1 wherein at least one of said stabilizing cables includes a tension adjustor.

5. The bowling lane masking unit in claim 4 wherein both of said stabilizing cables include a tension adjustor.

6. The bowling lane masking unit in claim 1 wherein said masking unit has a support at least at the bottom portion of said masking unit, and said support mounts said first and second pulley wheels.

7. The bowling lane masking unit in claim 2 wherein said latch is pivotally mounted to shift to the panel retaining condition.

8. The bowling lane masking unit in claim 7 wherein said latch is biased toward said panel retaining condition.

9. A bowling lane masking unit comprising:

a pair of upright, parallel, vertically oriented supports spanning a space therebetween for receiving a masking unit, each support having an upper end portion and a lower end portion;

a masking unit between said supports comprising a masking panel, at least a pair of lower corners opposite each other, and a pair of first and second pulley wheels at each said corner;

a pair of lower and upper stabilizing cable anchors, said lower stabilizing cable anchors being at said lower end portions and said upper stabilizing cable anchors being at said upper end portions;

a pair of stabilizing cables extending between said supports, each of said stabilizing cables having one end attached to one of said lower cable anchors, extending over said first pulley wheel on the adjacent masking unit lower corner and under said second pulley wheel on the opposite masking unit lower corner, and having a second end attached to one of said upper cable anchors at the opposite support, whereby said masking unit can be elevated in a stabilized manner by lifting at any portion of said masking unit; and at least one latch adjacent said panel shiftable to retain said panel in elevated position.

10. The bowling lane masking unit in claim 9 wherein said latch is pivotally mounted to shift to the panel retaining condition.

11. The bowling lane masking unit in claim 10 wherein said latch is biased toward said panel retaining condition.

12. The bowling lane masking unit in claim 11 wherein said latch is pivotally mounted to one of said upright supports.

13. The bowling lane masking unit in claim 9 including a pair of suspension rope reels adjacent said lower corners, and having suspension ropes, said suspension ropes extending from said reels and having an upper end anchored adjacent said upper end portions of said supports, for assisting elevation of said masking unit.

14. A bowling lane masking unit comprising:

an upper masking panel having a length sufficient to extend across at least one bowling lane;

a pair of upright, parallel, vertically oriented supports spanning a space therebetween for receiving a lower masking unit, each support having an upper end portion generally behind said upper masking panel and a lower end portion below said upper masking panel;

a lower masking unit between said supports comprising a lower masking panel, at least a pair of lower corners opposite each other, and a pair of first and second pulley wheels at each said corner;

a pair of lower and upper stabilizing cable anchors, said lower stabilizing cable anchors being at said lower end portions and said upper stabilizing cable anchors being at said upper end portions;

a pair of stabilizing cables extending between said supports, each of said stabilizing cables having one end attached to one of said lower cable anchors, extending over said first pulley wheel on the adjacent lower masking unit lower corner and under said second pulley wheel on the opposite lower masking unit lower comer, and having a second end attached to one of said upper cable anchors at the opposite support, whereby said lower masking unit can be elevated in a stabilized manner generally behind said upper masking panel by lifting at any portion of said lower masking unit; and at least one latch adjacent said lower masking panel shiftable to retain said lower masking panel in elevated position.

15. The bowling lane masking unit in claim 14 wherein said latch is pivotally mounted to shift to the panel retaining condition.

16. The bowling lane masking unit in claim 14 wherein said latch is pivotally mounted to one of said upright supports.

17. The bowling lane masking unit in claim 14 including a pair of suspension rope reels adjacent said lower corners, and having suspension ropes, said suspension ropes extending from said reels and having an upper end anchored adjacent said upper end portions of said supports, for assisting elevation of said masking unit.

18. The bowling lane masking unit in claim 14 wherein at least one of said stabilizing cables includes a tension adjustor.

19. The bowling lane masking unit in claim 18 wherein both of said stabilizing cables include a tension adjustor.

* * * * *